US011794042B2

(12) United States Patent
Brady et al.

(10) Patent No.: US 11,794,042 B2
(45) Date of Patent: Oct. 24, 2023

(54) NOSE FILTERING DEVICE

(71) Applicants: John Brady, Bensalem, PA (US); Mike Ditro, Philadelphia, PA (US)

(72) Inventors: John Brady, Bensalem, PA (US); Mike Ditro, Philadelphia, PA (US)

( * ) Notice: Subject to any disclaimer, the term of this patent is extended or adjusted under 35 U.S.C. 154(b) by 225 days.

(21) Appl. No.: 17/088,092

(22) Filed: Nov. 3, 2020

(65) Prior Publication Data

US 2021/0370109 A1 Dec. 2, 2021

Related U.S. Application Data

(60) Provisional application No. 63/031,649, filed on May 29, 2020.

(51) Int. Cl.
*A62B 23/06* (2006.01)

(52) U.S. Cl.
CPC ..... *A62B 23/06* (2013.01)

(58) Field of Classification Search
CPC ..... A62B 23/00; A62B 23/02; A62B 23/025; A62B 23/06; A62B 9/06; A62B 9/00; A62B 7/00; A62B 7/10; A41D 13/11; A41D 13/1107; A41D 13/1115; A41D 13/1123; A41D 13/113; A41D 13/1138; A41D 13/1146; A41D 13/1153; A41D 13/1161; A41D 13/1169; A41D 13/1176; A41D 13/1184; A41D 13/1192
See application file for complete search history.

(56) References Cited

U.S. PATENT DOCUMENTS

| | | | | |
|---|---|---|---|---|
| 3,457,917 | A * | 7/1969 | Mercurio | A62B 23/06 55/DIG. 35 |
| 3,905,335 | A * | 9/1975 | Kapp | A62B 23/06 128/206.11 |
| 4,221,217 | A * | 9/1980 | Amezcua | A62B 23/06 128/203.22 |
| 5,890,491 | A * | 4/1999 | Rimkus | A62B 23/06 128/204.12 |
| 11,253,014 | B1 * | 2/2022 | Mosaddegh | A62B 23/06 |
| 2004/0194784 | A1 * | 10/2004 | Bertrand | A62B 23/06 128/205.27 |
| 2007/0044801 | A1 * | 3/2007 | Mathis | B32B 5/26 128/206.13 |
| 2007/0175478 | A1 * | 8/2007 | Brunst | A62B 23/06 128/206.17 |
| 2007/0193233 | A1 * | 8/2007 | Chen | A61M 15/085 55/385.1 |

(Continued)

*Primary Examiner* — Colin W Stuart
(74) *Attorney, Agent, or Firm* — Brennan, Manna & Diamond, LLC

(57) ABSTRACT

The present invention relates to an individualized air filtration device including a generally inverted U-shaped nose ring and filter combination that fits partially within the nostrils of a user to prevent bacteria, microbes, particulate matter and viruses from entering the body through the user's nasal passages. The nose filtering device is preferably comprised of a nylon mesh material with an acetate fibrous material on at least the backside of the filter so that a hydrogen peroxide or other protective solution can be applied to the device before inserting the filter into the user's nostrils. The solution is preferably comprised of a hydrogen peroxide, but may also include a fragrance, medicine, therapeutic agent, camphor, *eucalyptus* oil, and a menthol.

14 Claims, 3 Drawing Sheets

(56) References Cited

U.S. PATENT DOCUMENTS

| | | | | |
|---|---|---|---|---|
| 2008/0053448 | A1* | 3/2008 | Liska | A62B 23/06 128/205.29 |
| 2009/0007919 | A1* | 1/2009 | Dolezal | A62B 7/10 128/206.11 |
| 2010/0147307 | A1* | 6/2010 | Narciso | A62B 23/06 128/206.11 |
| 2010/0239625 | A1* | 9/2010 | Puckett | A41D 13/1115 424/402 |
| 2014/0123982 | A1* | 5/2014 | Maddock | A62B 23/06 128/206.11 |
| 2019/0070441 | A1* | 3/2019 | Archouniani | A62B 23/06 |
| 2020/0261752 | A1* | 8/2020 | Frank | A62B 23/06 |

* cited by examiner

NOSE FILTERING DEVICE

CROSS-REFERENCE TO RELATED APPLICATION

The present application claims priority to, and the benefit of, U.S. Provisional Application No. 63/031,649, which was filed on May 29, 2020 and is incorporated herein by reference in its entirety.

BACKGROUND OF THE INVENTION

The present invention relates generally to the field of air filtration devices. More specifically, the present invention relates to an individualized air filtration device comprising a generally U-shaped nose ring and filter combination that fits partially within the nostrils of a user to prevent bacteria, microbes, particulate matter and viruses from entering the body through the user's nasal passages. The nose filtering device is preferably comprised of a nylon mesh material with an acetate fibrous material on at least the backside of the filter so that a hydrogen peroxide or other protective solution can be applied to the device before inserting the filter into the user's nostrils. The fibrous material may be disposed on either side of the structure, or all around the filter. Nonetheless, positioning the fibrous material on the backside provides protection for the air flowing into the nasal cavity. Additionally, hydrogen peroxide has antibacterial properties (e.g., when the oxygen is released from the hydrogen peroxide) that can help in eliminating harmful microbes, and the hydrogen peroxide solution of the invention has approximately two thirds (⅔) water and one third (⅓) peroxide. The nose filtering device of the present invention is fully seated or positioned within the nostrils of the user, and is not dislodged by normal activities such as talking, breathing and eating, but may still be released under the pressures of a sneeze. The nose filtering device may also be presented as a kit that is comprised of one or more nose filtering devices and the hydrogen peroxide solution. Accordingly, the present specification makes specific reference thereto. However, it should be appreciated that aspects of the present invention are also equally amenable to other like applications, devices and methods of manufacture.

By the way of background, the respiratory system of the human body is one of the main routes for entry of contaminants, dust and pathogens. The respiratory system includes the nose and mouth, trachea, bronchi and alveoli. The human anatomy is designed to process airborne pathogens and contaminants through the nose so that the air is purified, warmed and humidified before it reaches the individual's lungs. The hairs and mucous membranes inside the nose normally trap large particles of dirt, allergens, pollens and the like. However, such contaminants, when trapped by the mucous membranes, sometime cause a reaction where a histamine and other chemicals are released that result in swelling of the membranes, a runny nose, and/or nasal congestion. Further, the human respiratory system can be overwhelmed if its capacity to process airborne impurities is exceeded. Given that healthy lungs take two to three days to clear themselves after overloading, it is evident that a personal air filtering device to help protect from and remove inhaled allergens and particulates has great social and commercial value in addition to promoting individual health.

Additionally, most people are constantly at risk of contracting the common cold, the flu, and other viruses (e.g., Covid-19) while in public and exposed to airborne pathogens and other surfaces where bacteria may be found.

Wearing a personal protection equipment (PPE) mask typically designed to cover the nose and mouth of a user is an option for some people. However, most masks are typically only able to offer one layer of protection, and are not particularly effective in preventing the inhalation of such harmful particulates. More particularly, such masks are primarily intended to prevent the mask wearer from spreading particles to others from coughing, sneezing, normal exhalation, laughing and speaking, as opposed to protecting the wearer from inhaling the harmful particulates. Additionally, most face masks have a relatively loose fit that does not form a tight seal to the wearer's face, thereby not fully protecting the wearer against airborne pathogens as some entry is possible around the mask edges.

Additionally, the material from which traditional masks are fabricated is not sufficient to trap particles of very small size, and therefore does not adequately filter the incoming air from inhalation to the degree necessary to capture and prevent viruses from being inhaled. Face masks can also be uncomfortable to wear for extended periods of time, and cover a large portion of the face. People who might benefit from the masks frequently refuse to wear them, due to discomfort or dissatisfaction with the appearance of the mask or simply due to breathing difficulties, as masks tend to have poor air circulation while being worn. Moreover, general purpose masks tend to trap exhaled carbon dioxide, especially when the mask includes a microporous filter or the material in making the mask is overly dense so as to limit air flow. Accordingly, the longer a mask is worn, the greater the tendency for the buildup of carbon dioxide behind the mask. Users who are subjected to inhaling increased amounts of carbon dioxide over time are prone to headaches, drowsiness, and nausea, wherein prolonged exposure may cause even more severe effects.

Therefore, there exists a long felt need in the art for a nose filter that fits loosely, yet securely, inside the nostrils of a user to prevent bacteria, particulate and viruses from entering the body through the nasal passages. There is also a long felt need in the art for a nose filtering device that protects individuals from the cold, flu, and other viruses, diseases and infections that are contracted through the nasal passages. Additionally, there is a long felt need in the art for a nose filter device that can be applied with ease by children and adults alike, and that is comprised of an antiseptic to kill bacteria, germs, microbes and the like before they fully enter the nose or nasal passage. Moreover, there is a long felt need in the art for a nose filter device that utilizes a special solution capable of preventing microbial and bacterial infections. Finally, there is a long felt need in the art for a nose filter device configured to be soft and gentle to the interior of the user's nose, while effectively preventing airborne contaminates, environmental pollutants and other pathogens from entering the user's respiratory system.

The subject matter disclosed and claimed herein, in one embodiment thereof, comprises a nose filtering device comprised of a generally U-shaped nose ring and an antiseptic solution that kills bacteria before it enters the nose. The nose ring includes a filter at one end, wherein the filter is preferably comprised of a nylon mesh with an acetate fiber material on the backside of the filter so that a hydrogen peroxide solution can be applied thereto before inserting the device into the user's nostrils. The hydrogen peroxide solution is preferably comprised of two thirds water and one third peroxide by weight, which is effective in relieving congestion, preventing sinus infection, and eliminating microbial infection.

In this manner, the nose filtering device of the present invention accomplishes all of the forgoing objectives, and provides a relatively safe, easy, convenient and cost-effective solution to protecting against harmful airborne pathogens from entering the respiratory system of a user. The nose filtering device it also less expensive and more effective than other filtering solutions, does not consume much storage space, and is relatively easy to transport.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a nose filtering device having a hydrogen peroxide solution applied to a portion thereof. As used herein, the term "nose filtering device" refers to a semi-intrusive style nose filters, i.e., those which are designed to be inserted into a nasal passageway, such as the nostrils of an individual. The nose filter device is comprised of two interconnected generally U-shaped nose rings, one for each nostril, wherein each nose ring includes a filter having a nylon mesh with an acetate fibrous material on the backside of the filter. A hydrogen peroxide solution is applied to the filter and provides additional protection against airborne pathogens, as well as protecting the individual from colds, the flu, and other viruses, diseases and infections that may otherwise be contracted through the nasal passages.

In a further embodiment of the present invention, a composition for use with a nose filtering device that is useful for protecting against airborne pathogens and the like, colds, the flu, and other viruses, diseases and infections contracted through the nasal passages is disclosed. The composition is comprised mainly of a water and a peroxide, such as hydrogen peroxide. Nonetheless, additional additives may also be included such as a scent, fragrance or aloe to help reduce the sensitivity of the nasal passage to the nasal filtering device. In a preferred embodiment of the present invention, the active components of the composition are approximately two thirds water and approximately one third peroxide by concentration. The concentration of peroxide in the composition of the present invention is specifically designed to not cause irritation to the user's nostrils.

In yet another embodiment of the present invention, a unique filter membrane for use with the nose filtering device is disclosed. The filter membrane preferably comprises a nylon mesh, an acetate fibrous material, and a plurality of pores or openings that provide a passageway for the filtered air to pass through to the nasal passage of the user. The filter membrane of the present invention provides an effective way to prevent the passage of particulates having a diameter that is greater than 10 microns. In a more preferred embodiment, the filter membrane of the present invention provides an effective way to prevent the passage of particulates having a diameter that is greater than 5 microns, and more preferably a diameter that is greater than 1 micron. Nonetheless, the filter membrane of the present invention provides for the efficient filtration of particulate matter between 2.5 parts per million (ppm) and 10 ppm, along with other pollutants such as, but not limited to, vehicle exhaust, pollen, germs, dander and other airborne viruses and bacteria, all while maintaining a minimum pressure difference along the filter to allow for relatively easy and unrestrained breathing by the user.

In yet a further embodiment of the present invention, a method for delivering medication to a user is disclosed. The method comprises the steps of initially providing a nose filtering device having two interconnected and generally U-shaped nose rings joined to one another through a connector, and each having a filter. Next, the filter in one or both of the nose rings is exposed to a concentrated and medicated solution in order to impregnate the filter with the solution. The nose filtering device with the medicated filters contained therein is then gently inserted into the nostrils of the user until the nose filtering device is properly and securely positioned within the nostrils.

In yet another embodiment of the present invention, a kit for the prevention of airborne disease transmission is presented and includes a nostril insert. The nostril insert is comprised of a base having first and second support members, each of the first and second support members further having a center point and a series of ribs radiating out from the center point to form separate areas for air ingress and egress. In a preferred embodiment, each of the support members has an equal number of ribs for the relatively even distribution of airflow. A bridge connects the first and second support members to one another, and a porous filter element is placed on each of the first and second support members. The filter element is sized and configured to fit within a nostril of a user, and a medicated or anti-bacterial solution may be applied to one or both of the filter elements prior to application of the nostril insert to the face of the user.

In a further exemplary embodiment of the present invention, a nostril insert is presented and includes a first and second conically shaped filter element, with each of the filter elements positioned on a base member and inserted into a respective nasal passage of a user. Each of the base members has a center point and a plurality of ribs extending radially outwardly from the center portion, thereby forming a series of equally sized areas. A connecting bridge connects the first and second filter elements to one another, and the connecting bridge spaces the first filter element from the second filter element. Each of the filter elements has a nylon mesh material and a diameter ranging from 8 to 15 mm.

The nose filter of the present invention is particularly advantageous because it is easy to use, has a minimal impact on the appearance of the user, and provides a more effective and longer-lasting means of air filtration than face mask type devices and without becoming easily dislodged during use. The nose filtering device of the present invention also cleanses the air that passes through it so that the user's lungs receive fresh air, and the individual remains healthy. The nasal filtering device also dilates the nostrils of the user and enlarges the nasal passageways, thereby allowing more air to pass through. The frame of the nose filtering device is also comprised of a relatively soft and pliable plastic material in the general shape of a triangle or flattened cone that interacts with the contours of the user's nasal passageway, and is barely visible to others.

Further, the nose filtering device of the present invention may be compactly packaged for convenient transportation, storage and use. More specifically, the nose filtering device may be packaged in a sheet of packaging paper or plastic, or in a blister package, thereby enabling multiple units to be sold and dispensed in a single package.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE INVENTION

Figure 1A:
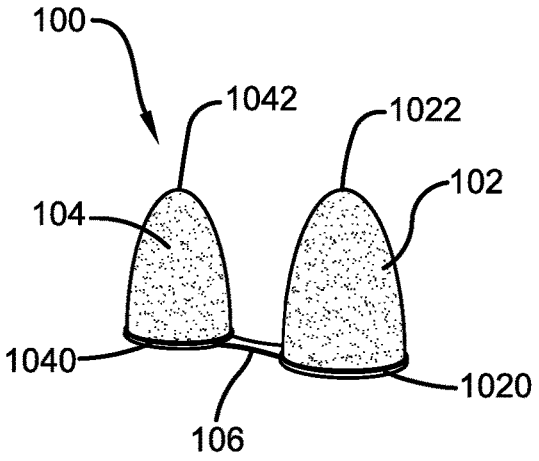
FIG. 1*a* illustrates a perspective view of one potential embodiment of a nose filtering device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long felt need in the art for a nose filtering device that fits securely inside the nostrils of a user and that prevents bacteria, particulates and viruses from entering the body through the user's nasal passages. There is also a long felt need in the art for a nose filtering device that protects individuals from the cold, flu, and other viruses, diseases and infections, and that can be easily applied by children and adults alike. Additionally, there is a long felt need in the art for a nose filtering device that is impregnated with an antiseptic to kill bacteria, germs, microbes and the like before they fully enter the nose or nasal passage of the user, as well as a special solution that is capable of preventing microbial and bacterial infections. Finally, there is a long felt need in the art for a nose filtering device that does not cause discomfort to the user, and that may be infused with a scent or fragrance in accordance with a user's needs and/or preferences.

The present invention, in one exemplary embodiment, is a semi-intrusive style nose filtering device comprised of a generally U-shaped nose ring filter combination that fits inside the nostrils of a user to prevent bacteria and viruses from entering the body through the user's nasal passages. The nose ring combination is further comprised of a nylon mesh with an acetate fiber material on the backside of the filter, wherein the filter is impregnated with a hydrogen peroxide solution before inserting the filter into the nostrils and nasal passageway of the user. The mesh is appropriately sized and configured to prevent particulates having a diameter of more than 5 microns from passing through and into the nasal passage. The hydrogen peroxide solution of the invention is preferably comprised of two thirds water and one third peroxide. The nose filtering device of the present invention is an improved personal air purification device which may be fully seated within the nostrils and nasal passageways of the user, and is not easily dislodged by routine activities such as talking and eating but is releasable under the pressure or force of a sneeze. More specifically, the invention is able to withstand pressures or forces of between 2.9 to 3.1 g or a velocity of about 10 mph and still remain in place within the nasal cavity without having to be reinserted.

Referring initially to the drawings, FIG. 1 illustrates a perspective view of a nose filtering device 100 of the present invention in accordance with the disclosed architecture. Nose filtering device 100 is preferably comprised of two generally U-shaped nose rings, namely a first U-shaped ring 102 and a second U-shaped ring 104, for a left nostril and a right nostril, respectively. The size or diameter of each of the nose rings 102, 104 is between 8 to 15 mm, and more specifically 10 to 12 mm, for fitting into an adult nasal passage. U-shaped nose rings are connected to each other by a connector or a bridge 106. The two U-shaped nose rings 102, 104 are connected to one another by a bridge or connector 106 that ensures that the rings 102, 104 remain together during application or handling of the nose filtering device 100. The shape of the nose rings 102, 104 may also be triangular, conical or any other shape that is suitable for insertion into the nasal passageways of a user. The length of the connector 106 ensures proper positioning of the nose rings 102, 104 in the nostrils of the user, and the width of the connector 106 is preferably be less than half of the width of the columella portion of the user.

Each U-shaped nose ring 102, 104 has a filter 1024, 1044 and a frame 1026, 1046 to provide support for the filter. The overall width and dimensions of the filters 1024, 1044 and frames 1026, 1046 are such that the filters 1024, 1044 abut the nostrils when the nose filter device 100 is installed. The frame of the nose filter 100 is preferably comprised of a relative soft, pliable plastic material and has a first base 1020 for the first nose ring 102 and a second base 1040 for the second nose ring 104. The bases 1020, 1040 are shown as being generally circular, but may form a shape similar to the filter members (e.g., triangular, etc.). The frames 1026, 1046 are preferably made from a relatively soft medical grade plastic that is BPA and Phthalate-free. The first nose ring 102 is slightly tapered from a semi-cylindrical shape to a triangular shape from the first base 1020 towards a first spherical portion 1022. Similarly, the second nose ring 104 is also slightly tapered from a semi-cylindrical shape to a triangular shape from the second base 1040 towards a second spherical portion 1042. The tapered or ellipsoidal shape affords increased area available for air filtration. This advantage can be best appreciated when considering the surface area of a hemisphere, as compared to a disk of the same radius. More specifically, the hemisphere surface area is twice as large. The ellipsoidal and elliptical or conical filtering media can also be configured to enhance the advantage of providing effective surface areas more than twice the area of the entrance to the nasal cavity.

Figure 1B:
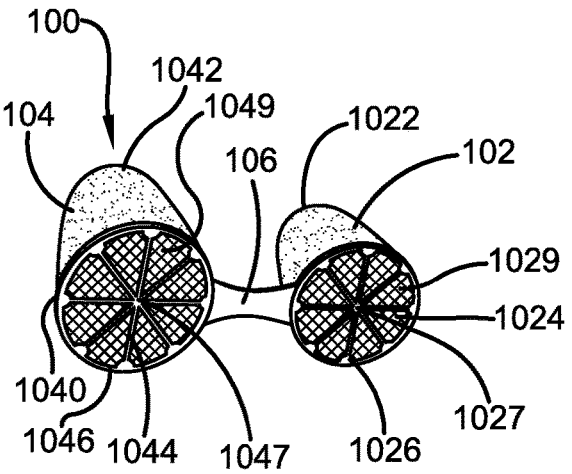
FIG. 1*b* illustrates a bottom perspective view of one potential embodiment of a nose filtering device of the present invention in accordance with the disclosed architecture, wherein the device is comprised of first and second filter portions.

FIG. 1*b* illustrates a bottom perspective view of one potential embodiment of a nose filtering device 100 of the present invention in accordance with the disclosed architecture, wherein the device is comprised of first and second filter portions 1024, 1044. Each of filters 1024, 1044 includes a nylon mesh on the base 1020, 1040 respectively, with an acetate fiber material on the backside (i.e., towards the semi-spherical portion 1022, 1042 of the filtering device 100). The filters 1024, 1044 effectively prevent bacteria, viruses, particulates and the like from entering the body through the nasal passages of the user. The filters 1024 and 1044 may be formed from a wide variety of materials, and further can be formed with a wide (i.e., several orders of magnitude) range of porosities, depending on the nature of the contaminants to be filtered by the nose filtering device 100. Each of the filters 1024, 1044 has a substantially uniform thickness, and in general has a tapered shape towards the semi-spherical portion 1042, 1022 to provide a filter shape that better conforms to the nasal cavity of the user. The filters 1024, 1044 are supported by the frame arms 1026, 1046 present at the respective bases 1020, 1040 of the frame. The frame arms 1026, 1046 extend radially outwardly from a central point 1027, 1047 of the first and second support and divide up the area equally forming a series of equilateral triangles 1029, 1049 in each of the respective filter units. As best shown in FIG. 1*b*, eight separate equilateral triangles may be formed by the frame arms 1026, 1046, but there may be any number of areas in the filter assembly including, without limitation, from 2 to 12.

Figure 2:
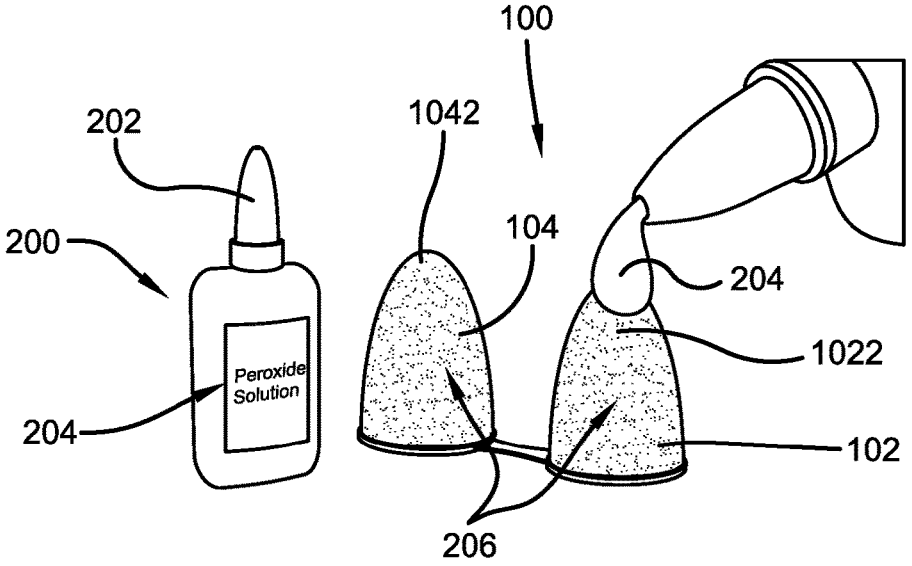
FIG. 2 illustrates a perspective view of one potential embodiment of a kit comprising a nose filtering device of the present invention and a peroxide solution in accordance with the disclosed architecture, wherein the nose filtering device is being impregnated with the peroxide solution prior to use.

FIG. 2 illustrates a perspective view of one potential embodiment of a kit comprising a nose filtering device 100 of the present invention and a peroxide solution 204 in accordance with the disclosed architecture, wherein the nose filtering device 100 is being impregnated with the peroxide solution 204 prior to use. More specifically, a unique hydrogen peroxide solution is available in a container or bottle 200 having a sealed cap 202, similar to that containing eye droplets. The hydrogen peroxide solution 204 is preferably comprised of approximately two-thirds water and approximately one-third peroxide. Notwithstanding, other additives may be included such as a fragrance, scent, lotions such as an aloe-based material to help smooth the insertion process, etc. Before using the nose filtering device 100, the hydrogen peroxide solution 204 is applied onto an acetate fiber material 206 present on the first semi-spherical portion 1022 of the first nose ring 102. Similarly, hydrogen peroxide 204 is applied onto the acetate fiber material 206 present on the second semi-spherical portion 1042 of the second nose ring 104. A few drops of the hydrogen peroxide solution 202 may also be applied to the filters 1024, 1044 of the nose filtering device flu fighter nose filtering device 100 to provide additional protection against airborne pathogens, and protect individuals from the cold, flu, and other viruses, diseases and infections that are contracted through the nasal passages. Once the hydrogen peroxide solution 204 is applied onto the acetate fiber material 206, the solution 204 impregnates the upper portions of the filter through the pores therein, and purifies the air inhaled by the user through the nasal passageways.

The container 200 may be of any suitable shape and size, including but not limited to, rectangular, cubic, pyramidal, cylindrical, spherical in which the hydrogen peroxide solution 204 to securely stored. Although the container 200 is generally made of plastic material such as polyethylene, in other embodiments, the container 200 may be made of any other suitable material for storing a liquid at least partially comprised of a peroxide. The container 200 shown in FIG. 2 is not limited to any particular size or shape.

Figure 3:
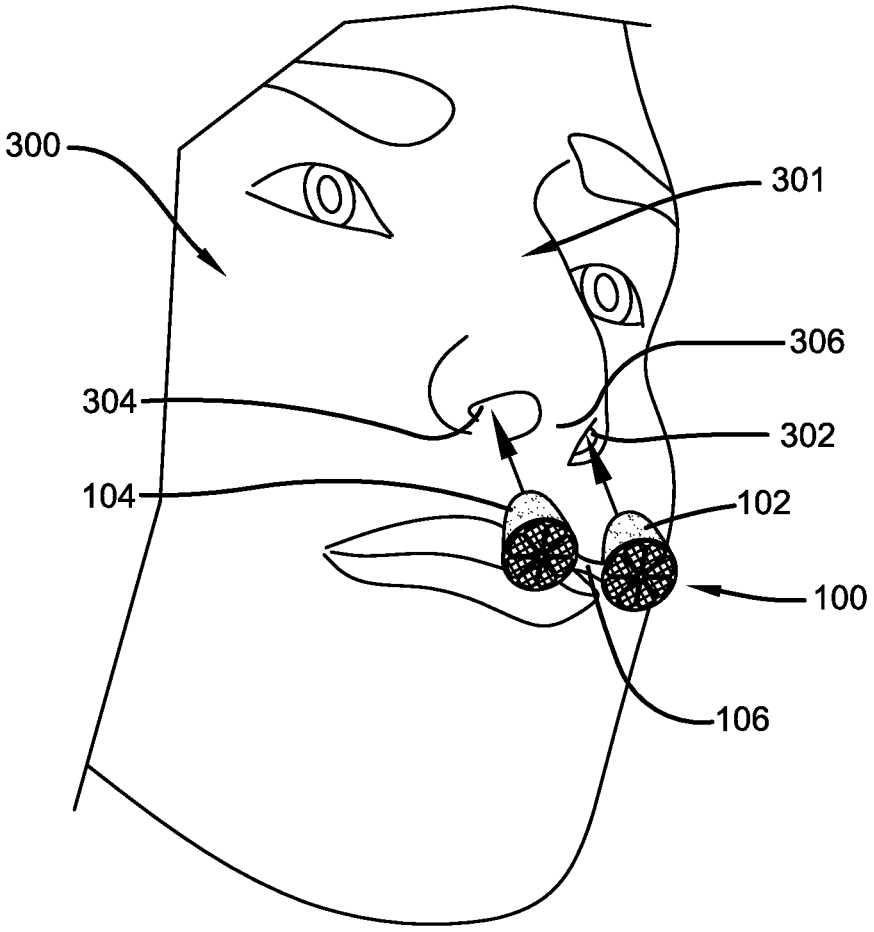
FIG. 3 illustrates a method of inserting one potential embodiment of the nose filtering device of the present invention into the nostrils of a user in accordance with the disclosed architecture.

FIG. 3 illustrates a method of inserting one potential embodiment of the nose filtering device 100 of the present invention into the first and second nostrils 302, 304 of a user 300 in accordance with the disclosed architecture. More specifically, once taken out from its packaging and impregnated with the hydrogen peroxide solution 204, the nose filtering device 100 of the present invention may be held by the connector 106 by using the thumb and index finger of the user 300. The user 300 then inserts the first nose ring 102 into the first nostril 302, and the second nose ring 104 into the second nostril 304 such that the connector 106 is positioned immediately adjacent to and abuts the columella 306 of the user 300. Each nose ring 102, 104, when in its working position, is spaced apart from the septum of the nose 301 of the user 300.

Figure 4:
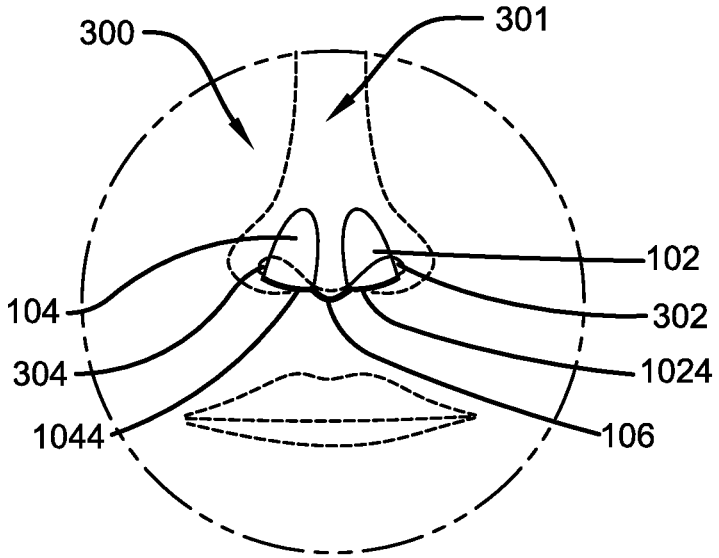
FIG. 4 illustrates a schematic view of one potential embodiment of the nose filtering device of the present invention inserted into the nostrils of a user in accordance with the disclosed architecture.

FIG. 4 illustrates a schematic view of one potential embodiment of the nose filtering device 100 of the present invention inserted into the first and second nostrils 302, 304 of a user 300 in accordance with the disclosed architecture. More specifically, the generally inverted U-shaped nose rings 102, 104 are positioned inside the nostrils 302, 304, with bridge or connector 106 spanning the septum of the nose 301. This forms a close fit in which the filters 1024, 1044 tend to generally conform to the nasal cavity entrances 302, 304 respectively, forming a substantially contiguous surface engagement that frictionally maintains each filter 1024, 1044 within its associated nasal cavity 302, 304, and preferably provides a seal. As a result of this positioning, and the close fit between bases 1020, 1040 and the nasal cavities 302, 304, air entering into the nasal cavity 302 passes through each of the filters 1024 and the nose ring 102. Likewise, air entering the nasal cavity 304 passes through each of the filter 1044 and the nose ring 104. The connector 106 sets a desired spacing between bases 1020, 1040, and thus facilitates proper positioning of filters 1024, 1044 in their respective nasal cavities 302, 304. The bridge or connector 106 also prevents over insertion of the filters 1024, 1044 into the nostrils 302, 304 by virtue of its contact with the septum, and remains easily accessible to the user 300 when desiring to remove the nose filtering device 100 after use.

Figure 5:
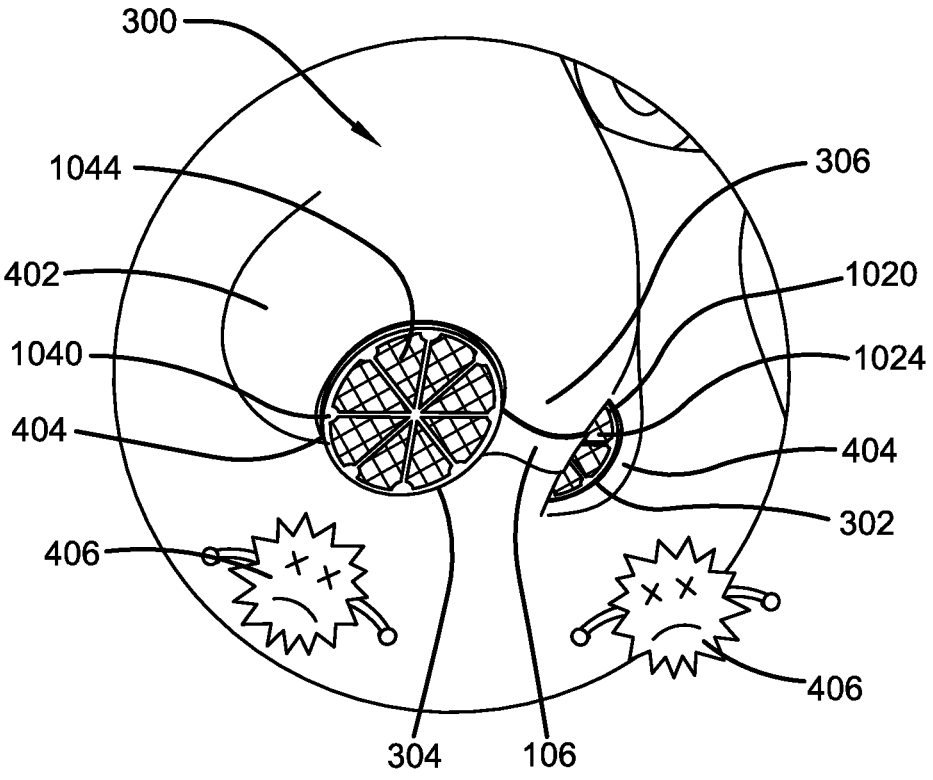
FIG. 5 illustrates a bottom perspective view of one potential embodiment of the nose filtering device of the present invention inserted into the nostrils of a user in accordance with the disclosed architecture, and successfully preventing harmful particulates from entering into the user's nasal passageways.

FIG. 5 illustrates a bottom perspective view of one potential embodiment of the nose filtering device 100 of the present invention inserted into the nostrils 302, 304 of a user 300 in accordance with the disclosed architecture, and successfully preventing harmful particulates 406 from entering into the user's nasal passageways. By way of background, each of nostrils 302, 304 has three main components, namely a sill 404, an ala 402 and the columella 306. The shape of the nose rings 102, 104 of the filtering device 100 is configured according to these peripheral portions of the nostrils 302, 304. As shown in FIG. 5, the shape of the filters 1024, 1044 is broadly covering the nostrils 302, 304 respectively, and the shape is designed so that such coverage is available regardless of the particular shape of the user's nose 301. More specifically, the base of the nose rings 102, 104 need to be first secured to the sills 404 to ensure that nose rings 102, 104 coincide with the nasal cavities 302, 304. Further, the user 300 has to press from the ala 402 using thumbs and then to the columella 306 to ensure complete sealing of the filtering device 100 within the nasal passageways. The material used in the construction of the filtering device 100 is capable of minor expansion and retraction with each breath by the user 300 so as to maintain a tight fit within the nasal passages 302, 304. More specifically, the pliable nature of the material allows further softening when heated after insertion into the passageway.

In one embodiment, the filter element 1024, 1044 of the nose filtering device 100 may be of the disposable-type, and may be fabricated of a porous, absorbent, perforate, lightweight, non-allergenic, fibrous material. The filter element 1024, 1044 are also easily replaceable, and adapted to be impregnated with various aromas, pleasant-smelling odorants or fragrances, medicines, and therapeutic agents. In view of the nose filtering qualities and porous construction, the nose filtering device 100 not only allows a user 300 to breathe clean air in a normal, unobstructed manner, but it also enhances the user's overall health. Additionally, the filtering action of the filters 1024, 1044 may be enhanced by the use of an absorbent material, such as a charcoal being dispersed therethrough. Other components that may be added to the filters 1024, 1044 include, but are not limited to, camphor, *eucalyptus* oil and menthol which can further help open the nasal passages 302, 304.

The nose filter 100 can also be used as a medicine delivery device for medicine that is inhaled. For example, a user 300 may apply a small amount of medicine, such as a few drops of a decongestant or antihistamine, to the acetate fiber material 206 before using the nose filtering device 100. The medication would be breathed in normally by the user 300 over a longer period of time. A wide variety of medicinal applications are contemplated. Alternatively, the nose rings 102, 104 may be impregnated with other constituents for therapeutic applications including, without limitation, aroma therapies or to provide a cover aroma.

The nose filtering device 100 of the present invention may be operative for filtering dust, germs, allergic matter, bacteria, virus or other foreign particulate from the air passing through the nostrils and into the sinus cavity. It has been found that as the air passes through the filters 1024, 1044, the hydrogen peroxide solution 204 helps reduce sinus problems and improves of the overall health of the user's lungs. The nose filtering device 100 is designed to be easily inserted and removed from the nostrils 304, 304 of the user, and to quickly conform to the shape of the nasal passageway without irritating the sensitive inner wall of the nostrils.

The nose filtering device 100 according to the present invention prevents bacteria, viruses and the like from entering the body through the nasal passages, and eliminates the need for individuals to wear a face mask for protection. The invention includes a hydrogen peroxide solution within the filter that provides additional protection against airborne pathogens, and protects individuals from the cold, flu, and other viruses and infections that are contracted through the nasal passages. The invention offers peace of mind to individuals that they have protective measures in place to reduce the chance of infection.

The filter membrane of the present invention provides for the efficient filtration of particulate matter between 2.5 parts per million (ppm) and 10 ppm, along with other pollutants such as, but not limited to, vehicle exhaust, pollen, germs, dander and other airborne viruses and bacteria, all while maintaining a minimum pressure difference along the filter to allow for relatively easy and unrestrained breathing by the user. Additionally, the design of the nose filtering device 100 is cost effective, easy to construct and simple to use. The acetate fiber material used in the present invention are molded from solutions of cellulose acetate in organic solvents. Further, the acetate fibers used are soft and pleasant to the touch. The breathable nature of the fabric enhances the performance of the fiber in the nose filtering device 100. The nose filtering device 100 may be made available in different sizes and colors to accommodate user need and/or preference.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "nose filter", "flu nose filter", "flu fighter filter", "nose filtering device", and "flu fighter" are interchangeable, and refer to the nose filtering device 100 of the present invention.

Notwithstanding the forgoing, the nose filtering device 100 of the present invention can be of any suitable size and configuration as is known in the art without affecting the overall concept of the invention, provided that it accomplishes the above stated objectives. One of ordinary skill in the art will appreciate that the size, configuration and material of the nose filtering device 100 as shown in the FIGS. are for illustrative purposes only, and that many other sizes of the nose filtering device 100 are well within the scope of the present disclosure. Although the dimensions of the nose filtering device 100 are important design parameters for user convenience, the nose filtering device 100 may be of any size that ensures optimal performance during use and/or that suits users need and/or preference.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A personal nasal protection device comprising;

a base having a first support member and a second support member, wherein each of the first and second support members are comprised of a center point and a plurality of ribs radiating out from the center point to form a plurality of separate areas for air ingress and egress;

a bridge connecting the first and second support members to one another; and a porous filter element placed on each of the first and second support members, each porous filter element generally conically shaped terminating in a semi-spherical portion; and wherein each porous filter element comprises a nylon mesh attached to the base and an acetate fiber portion extending from the nylon mesh configured to fit within a nasal passage of a nostril and expand and retract within the nasal passage to maintain a tight fit during breathing by a user.

2. The personal nasal protection device of claim 1, wherein the personal nasal protection device can withstand a velocity of up to 10 mph before being dislodged from the nostril.

3. The personal nasal protection device of claim 1, wherein each of the plurality of separate areas between the plurality of ribs and the center point form a triangle.

4. The personal nasal protection device of claim 1, wherein each of the porous filter elements has a diameter of between 8 to 15 mm.

5. The personal nasal protection device of claim 1, wherein each of the porous filter elements has a diameter of between 10 to 12 mm.

6. The personal nasal protection device of claim 1, wherein each of the porous filter elements has absorptive capabilities.

7. The personal nasal protection device of claim 1, wherein the nylon mesh is configured to prohibit a particulate of more than 5 microns from passing through the nylon mesh.

8. A nostril insert comprising;

a first filter element and a second filter element, wherein each of the first and second filter elements is generally conically shaped terminating in a semi-spherical portion for insertion into a nostril;

a first base member and a second base member, wherein each of the first and second base members is comprised of a center point and a plurality of ribs extending radially outwardly from the center point forming a plurality of equally sized areas and is impregnated with an aromatic compound;

a connecting bridge connecting the first and second filter elements to one another in a spaced apart fashion; and each of the first and second filter elements has a diameter ranging from 8 to 15 mm; and wherein each of the first and second filter elements are replaceable; and wherein each of the first and second filter elements comprise a nylon mesh attached to the respective first and second base members and an acetate fiber portion extending away from the nylon mesh configured to fit within a nasal passage of a nostril and expand and retract within the nasal passage to maintain a tight fit during breathing by a user; and wherein the acetate fiber portion is configured to soften when heated.

9. The nostril insert of claim 8, wherein the nostril insert can withstand a wind velocity of up to 10 mph before being dislodged from the nostril.

10. The nostril insert of claim 8, wherein the nylon mesh is configured to prohibit a particulate having a diameter of more than 5 microns from passing through the nylon mesh.

11. The nostril insert of claim 8, wherein each of the first and second filter elements is absorptive, is treated with a solution, is comprised of an acetate fiber.

12. The nostril insert of claim 11, wherein the solution is comprised of a hydrogen peroxide.

13. The nostril insert of claim 12, wherein the solution is comprised of at least one of a fragrance, a medicine, a camphor, a *eucalyptus* oil and a menthol.

14. A kit for the prevention of a transmission of an airborne disease comprising:

a nostril insert comprised of a base, a first support member, a second support member, a bridge connecting the first and second support members to one another, and a replaceable porous filter element placed on each of the first and second support members, wherein each of the first and second support members have a center point and a plurality of ribs radiating out from the center point to form a plurality of separate areas, and further wherein each replaceable porous filter element is generally conically shaped terminating in a semi-spherical portion and is sized and configured to fit within a nostril of a user; and a solution for applying to each porous filter element prior to insertion of the nostril insert into the nostril; and wherein the solution comprises a fragrance and a *eucalyptus* oil; and wherein each replaceable porous filter element comprises a nylon mesh attached to the respective first and second support members and an acetate fiber portion extending away from the nylon mesh configured to fit within a nasal passage of a nostril and expand and retract within the nasal passage to maintain a tight fit during breathing by the user; and wherein the acetate fiber portion is configured to soften when heated; and wherein the solution is comprised of a hydrogen peroxide and a water, wherein a ratio of the hydrogen peroxide to the water is approximately 1:2; and wherein the solution further includes at least one of a medicine and a therapeutic agent; a camphor, and a menthol; and wherein the nostril insert can withstand a wind velocity of up to 10 mph before being dislodged from the nostril.

* * * * *